US005855758A

United States Patent [19]

Mitchell et al.

[11] Patent Number: 5,855,758

[45] Date of Patent: Jan. 5, 1999

[54] CATHODE CONNECTION FOR ALUMINIUM SMELTER POT AND METHOD

[75] Inventors: John Leslie Mitchell; John Gregory Tink, both of Victoria, Australia

[73] Assignee: JMT Engineering Pty. Ltd., Victoria, Australia

[21] Appl. No.: 737,315

[22] PCT Filed: Jun. 9, 1995

[86] PCT No.: PCT/AU95/00339

§ 371 Date: Nov. 12, 1996

§ 102(e) Date: Nov. 12, 1996

[87] PCT Pub. No.: WO95/34696

PCT Pub. Date: Dec. 21, 1995

[30] Foreign Application Priority Data

Jun. 10, 1994 [AU] Australia ..... PM6213

[51] Int. Cl.[6] ..... C25C 3/16; H01R 43/00

[52] U.S. Cl. ..... 205/372; 204/243 R; 204/279; 29/825; 29/861

[58] Field of Search ..... 29/825, 857, 861; 204/279, 243 R, 244–247; 205/372

[56] References Cited

U.S. PATENT DOCUMENTS

| | | | |
|---|---|---|---|
| 3,453,198 | 7/1969 | Perabo | 204/279 |
| 3,644,862 | 2/1972 | Otake et al. . | |
| 3,821,101 | 6/1974 | Nikiforov et al. . | |
| 4,105,529 | 8/1978 | Pohto | 204/279 X |
| 4,160,717 | 7/1979 | Navaro et al. | 204/279 |
| 4,795,540 | 1/1989 | Townsend . | |
| 5,491,892 | 2/1996 | Fritz et al. | 29/857 |

FOREIGN PATENT DOCUMENTS

| | | |
|---|---|---|
| 64687/94 | 12/1994 | Australia . |
| 0 205 687 | 12/1986 | European Pat. Off. . |

OTHER PUBLICATIONS

Derwent Abstract Accession No. 84–144757/23, Class M28, SU 1041606 A1, 15 Sep. 1983.

Derwent Soviet Inventions Illustrated, Section 1, Chemical, vol. V, No. 23, Issued 12 Jul. 1974, Metallurgy, p. 11, SU 395500 A, 7 Jan. 1974.

*Primary Examiner*—Donald R. Valentine

*Attorney, Agent, or Firm*—Nikaido, Marmelstein, Murray & Oram LLP

[57] ABSTRACT

A connection assembly for the cathode of an aluminum smelter pot (10) including at least one insert (30) received within a hole in the collector bar (16) of a collector bar/strap (16/15) connection for the cathode and in electrical contact with the collector bar (16) and in electrical contact with the strap (15) via tab (15*a*).

25 Claims, 7 Drawing Sheets

FIG.6a
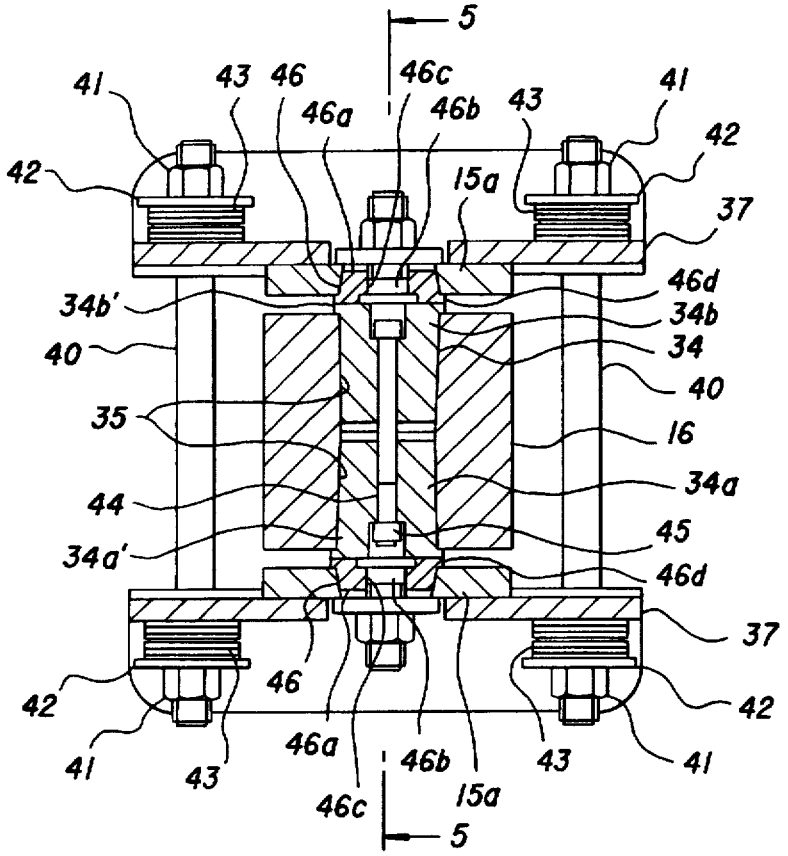
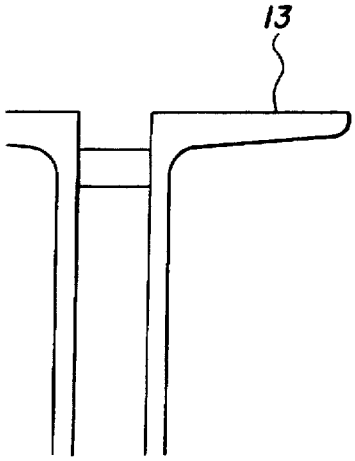
FIG.6b
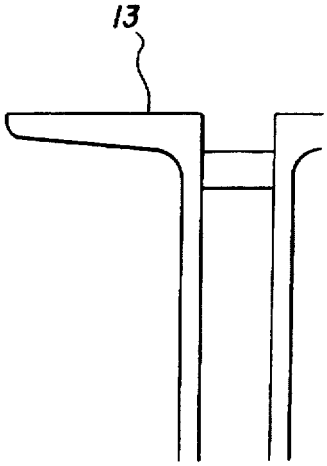
FIG.6c

CATHODE CONNECTION FOR ALUMINIUM SMELTER POT AND METHOD

This is a National Stage Application of PCT/AU95/00339, filed Jun. 9, 1995.

TECHNICAL FIELD

This invention relates to a cathode connection for an aluminium smelter pot or cell.

Aluminium production involves the processing of refined ore (bauxite is refined into alumina by removing mud and sand) into aluminium by an electrolytic process. This process involves the separation of alumina into its component parts of aluminium metal and oxygen gas, by electrolytic reduction in a bath of molten cryolite (sodium aluminium fluoride).

The process is a continuous process with alumina being dissolved in the cryolite bath at a temperature of around 940° C. and the aluminium separated by electrolysis is regularly removed for subsequent alloying and further treatment.

The reduction takes place in "pots" or "cells" (hereinafter referred to as pots) connected electrically in series, with the pots connected in this way being termed a "potline".

Direct current passes from the carbon anodes, through the cryolite bath containing aluminium in solution, to the cathode of one pot and then to the anodes of the next and so on. Steel bars embedded in the cathodes carry the current out of the pots. These bars are themselves connected by bolts or other jointing techniques to flexible straps which are then joined to a bus-bar system.

The pots consist of steel shells, in which the carbon cathode lining is housed. The shells hold the molten cryolite and alumina in solution and the molten aluminium created in the process. The molten aluminium settles in the bottom of the pots and is drawn off by a container called a vacuum crucible.

An electrically insulated superstructure, mounted above the shell, holds the carbon anodes and suspends them in the bath.

As the electrolytic reaction proceeds, aluminium is continuously deposited in a metal pool in the bottom of the pots and oxygen is liberated at the anodes, reacting with the carbon material of the anodes in the form of carbon dioxide.

As the anodes are consumed during the process, they must be continuously lowered to maintain a constant distance between them and the surface of the metal which is, in effect, the cathode.

The typical life of a pot is around 2,000 days, largely dependent on the installation of the pot lining or cathode assembly. For a smelter with some 400 pots, this means that an "old" pot is replaced with a "new" pot around every 5 days on average. For the period of the changeover of a pot, the electric circuit to the pot must be interrupted.

BACKGROUND ART

In a typical pot, around 40 steel bars are embedded in the carbon cathode and are used as current collector bars to carry current from the cell. These collector bars are then individually fastened by bolts to copper tabs fixed to flexible aluminium straps which are welded to the aluminium ring bus-bar system. Alternatively, an aluminium to steel transition joint is employed for the connection of the collector bar to the aluminium strap, this transition joint being welded on installation and cut at the time of pot removal.

For the bolted connections, contact pressure is critical to an acceptable joint.

A low resistance joint, typically 6 to 8 micro ohms, at these collector bar to strap connections (bar/strap connections) is very important to the efficiency of the process. High resistance joints limit the current able to be efficiently passed through the potline, cause higher than normal pot voltage and will cause unstable pot operation.

Collector bars are made from steel in order to withstand the high temperatures encountered during cell operation. Typically, the bar/strap connection effectively operates at a temperature of about 300° C. Steel has relatively poor electrical properties and this makes it difficult to achieve a good connection between the collector bar and the strap.

DISCLOSURE OF THE INVENTION

The present invention provides an improved connection for the cathode of an aluminium smelter pot, including at least one insert received within a hole in the bar of a bar/strap connection for the cathode and in electrical contact with the bar and in electrical contact with the strap.

The insert may be made of any material that has a higher electrical conductivity (i.e. lower resistivity) than the material used to make the collector bar.

Silver or silver alloys would be the material of choice for the insert if electrical properties were the only consideration. However, the high price of silver would be likely to render such inserts uneconomic. Preferably, the insert is made from a copper-based material, such as high conductivity copper, or copper alloys such as beryllium-copper or chromium-copperalloys. High conductivity copper would provide good electrical properties but it is possible that this material may soften at the high temperatures encountered during operation at some smelters. If this is a problem, harder copper alloys, such as beryllium-copper or chromium-copper, would be appropriate materials for use in the insert. It will be appreciated that the present invention is not limited to the materials specifically mentioned above but extends to cover any materials having higher electrical conductivity than the collector bar.

In order to further improve the quality of the joint, a suitable contact metal may be coated onto the insert. Any material that has a higher electrical conductivity than the material of the insert may be used to coat the insert. Silver or a silver alloy are especially suitable contact metals that may be applied to the insert.

The insert provides a high conductivity/low resistivity material that enables establishment of a good electrical connection between the collector bar and the strap. To ensure that a low resistance connection is obtained, the insert preferably includes at least one contact surface which, in use, provides the interface between the insert and the strap in the connection. The contact surface assists in securing good physical contact between the insert and the strap, which leads to improved electrical qualities in the connection.

Another advantage of the present invention is that much lower contact pressures in the joint are required to obtain a given contact resistance. In conventional bolted joints, it is necessary to tighten the bolts to very high pressures to attain a desired contact resistance in the joint. In contrast, using the present invention requires contact pressures that may be as much as an order of magnitude lower than in convention joints to achieve similar contact resistances. This is especially noticeable if the insert is silver coated and comes into contact with another silvered surface.

In an especially preferred embodiment, the connection s formed such that two contact surfaces are presented as interfaces. One of the contact surfaces should be presented on one side of the collector bar, usually the top side, and the other contact surface should be presented on the opposite side of the collector bar, usually the bottom side. Straps are connected to both of the contact surfaces to draw current from the bar. This arrangement provides symmetrical current dispersion from the bar.

The two contact surfaces may be provided by use of a single insert having a contact surface at both ends thereof. Alternatively, two separate inserts may be positioned within the hole in the collector bar, with each insert providing a contact surface for the connection interface.

The bus-bar straps placed in contact with the insert to form the connection generally have copper tabs on the ends thereof and it is the copper tabs that come into contact with the inserts in the connection. To further improve the quality of the electrical connection, the copper tabs may be coated with a suitable contact metal, such as silver or a silver alloy. Alternatively, the ends of the straps may be provided with inserts of a high conductivity material, which inserts contact the collector bar inserts to form the connection. The strap inserts preferably include a contact surface which, in use, forms part of the interface of the connection.

It is believed that straps that are fitted with new copper tabs would produce a satisfactory connection with the collector bar inserts without requiring the use of strap inserts. However, the copper tabs are then preferably coated with silver or a silver alloy. The condition of the copper tabs generally deteriorates over time with re-use following pot changeover and strap inserts may be required if previously used tabs are being utilised.

To achieve good electrical contact between the collector bar and the collector bar insert, the insert should be tightly fitted within the hole formed in the collector bar. The tight fit may be achieved by many different methods, all of which fall within the scope of the present invention.

In one method, the insert may be shrink-fitted into the hole in the collector bar. This method involves cooling the insert, for example in liquid nitrogen, and placing the cooled insert into the hole of the collector bar. As the insert warms, thermal expansion causes the insert to come into a tight fit with the collector bar.

An alternative method involves using a tapered insert that is capable of receiving a bolt or other fastening means. Placing the insert in the hole and tightening the bolt or other fastening means causes the tapered insert to tightly fit into the hole.

In yet a further alternative, a hollow insert may be provided, which insert has a tapered axial passage therein. Tightening of a bolt or other fastening means inserted into the tapered axial passage causes the insert to expand and come into tight contact with the collector bar.

It may also be possible to produce the insert in the collector bar by forming the insert on a prepared surface or surfaces of the collector bar rather than placing the insert in a hole in the collector bar. For example, an insert may be appropriately positioned on or within the collector bar and fixed by suitable means, such as welding to the collector bar. R F welding, ultrasonic welding or spot welding may be used to affix the insert to the collector bar.

The connection between the insert and the straps may be made by any suitable means. For example, the connection may be a bolted connection, a clamped connection or a biased connection. Use of a biased connection, such as disclosed in Australian Patent Application No. 64687/94, the entire contents of which are incorporated herein by reference, is especially suitable.

Preferably the biasing means is a spring or a stack of spring washers, such as belleville washers.

By the means of a spring (or spring washers) and a contact assembly, a contact pressure of approximately 2 to 4 tonnes is required across each contact, with a contact area, of approximately 3,000 sq. mm, to achieve an acceptable contact resistance.

Higher contact pressures can be achieved with different contact assembly designs. With existing bolted connections, a contact pressure of approximately 14 to 30 tonnes is required across a copper to steel contact, with a contact area of approximately 22,500 sq. mm, to achieve an acceptable contact resistance.

It will be appreciated that with such a connection, no bolted joint is necessarily required.

In another aspect, the present invention provides a collector bar including an insert formed within or mounted within the collector bar, the insert having a contact surface for providing an interface for a bar/strap connection.

In a further aspect, the present invention provides an insert for use in forming a connection between a collector bar and a bus bar strap, the insert comprising a body of material adapted to be received within a hole in the collector bar and whereby electrical contact between the insert and the collector bar is achieved, the insert having a contact surface at one end thereof, the contact surface forming part of an interface for the connection.

The insert may have another contact surface at the other end thereof to provide another interface for forming a connection between the collector bar and the strap.

In yet a further aspect, the present invention provides a method for forming an electrical connection between a collector bar of an aluminium smelter pot and a bus-bar strap comprising placing an insert into a hole in the collector bar such that the insert is in electrical contact with the collector bar, said insert having higher electrical conductivity than the collector bar, bringing the strap into contact with a surface of the insert and applying pressure to the strap such that the strap is forced into contact with the surface of the insert to bring the strap into electrical contact with the insert.

In the present invention, a very good connection is obtained when a contact surface of the insert colsely mates with a corresponding contact surface formed on or as part of the bus-bar strap and this represents a preferred embodiment of the invention. For example, the contact surfaces on the insert and the strap may be flat surfaces. More complex surface geometries may be used, such as a concave contact surface that mates with a corresponding convex surface, or indeed any other geometry in which one contact surface mates with its corresponding contact surface.

BRIEF DESCRIPTION OF THE DRAWINGS

Two embodiments of the invention will now be described with reference to the accompanying drawings, in which:

FIGS. 6A, 6B and 6C are enlarged cross-sectional views taken along line 6—6 of FIG. 5.

BEST MODES FOR CARRYING OUT THE INVENTION

Figure 1:
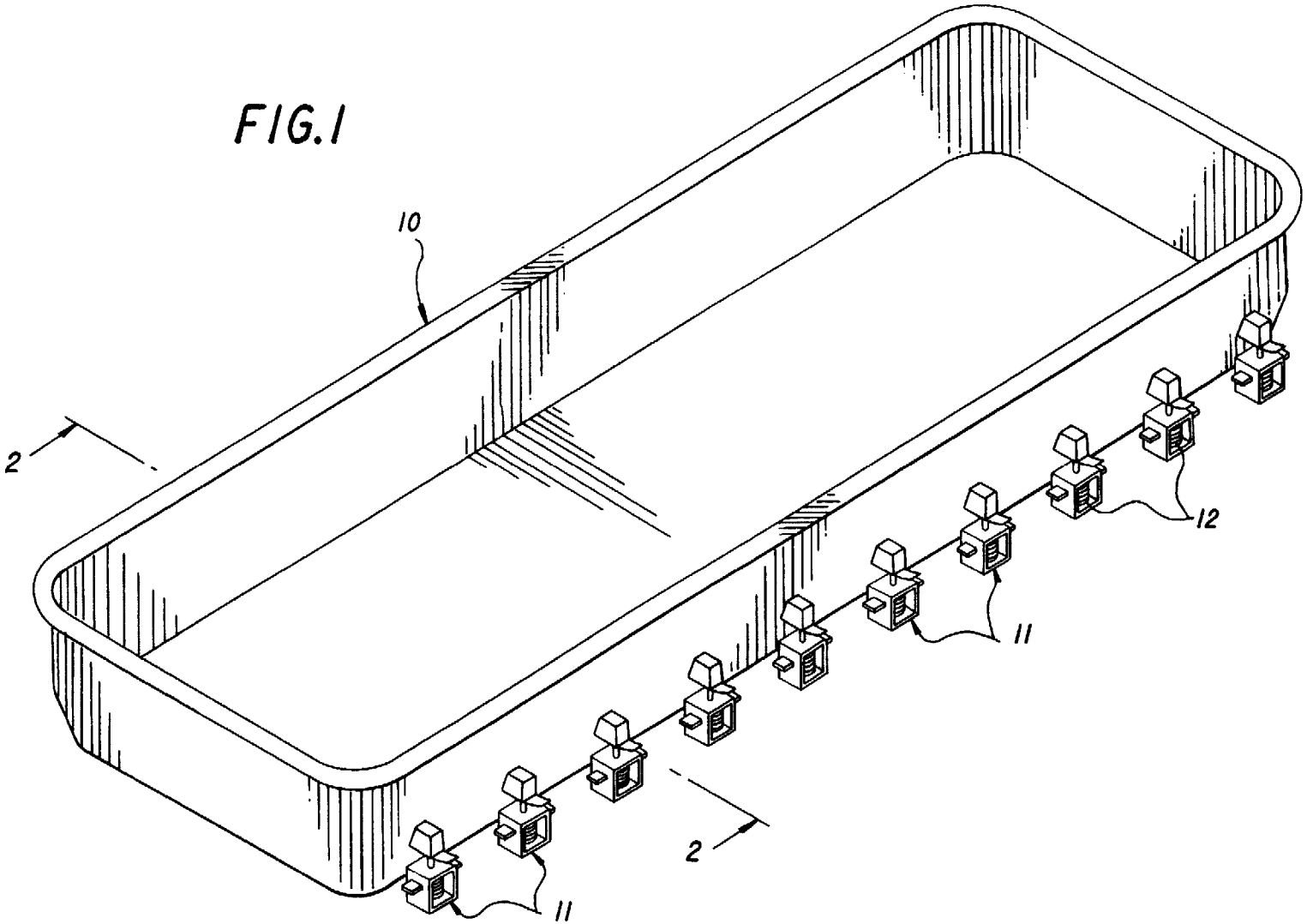
FIG. 1 is a schematic perspective view of a pot shell which will contain collector bars to which the connection of a first described preferred embodiment of the present invention will be applied.
Figure 2:
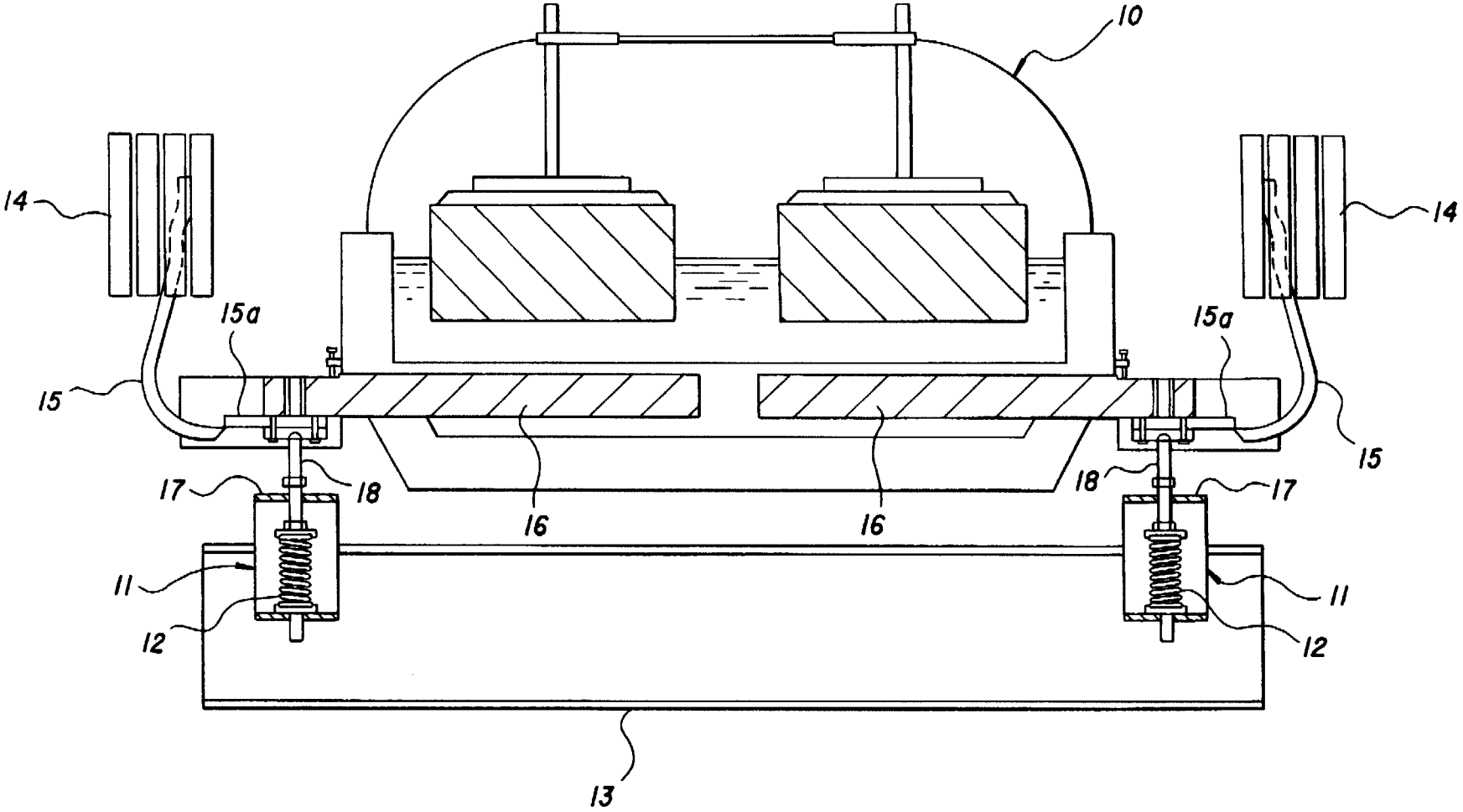
FIG. 2 is a more detailed cross-sectional view taken along line 2—2 of FIG. 1.
Figure 3:
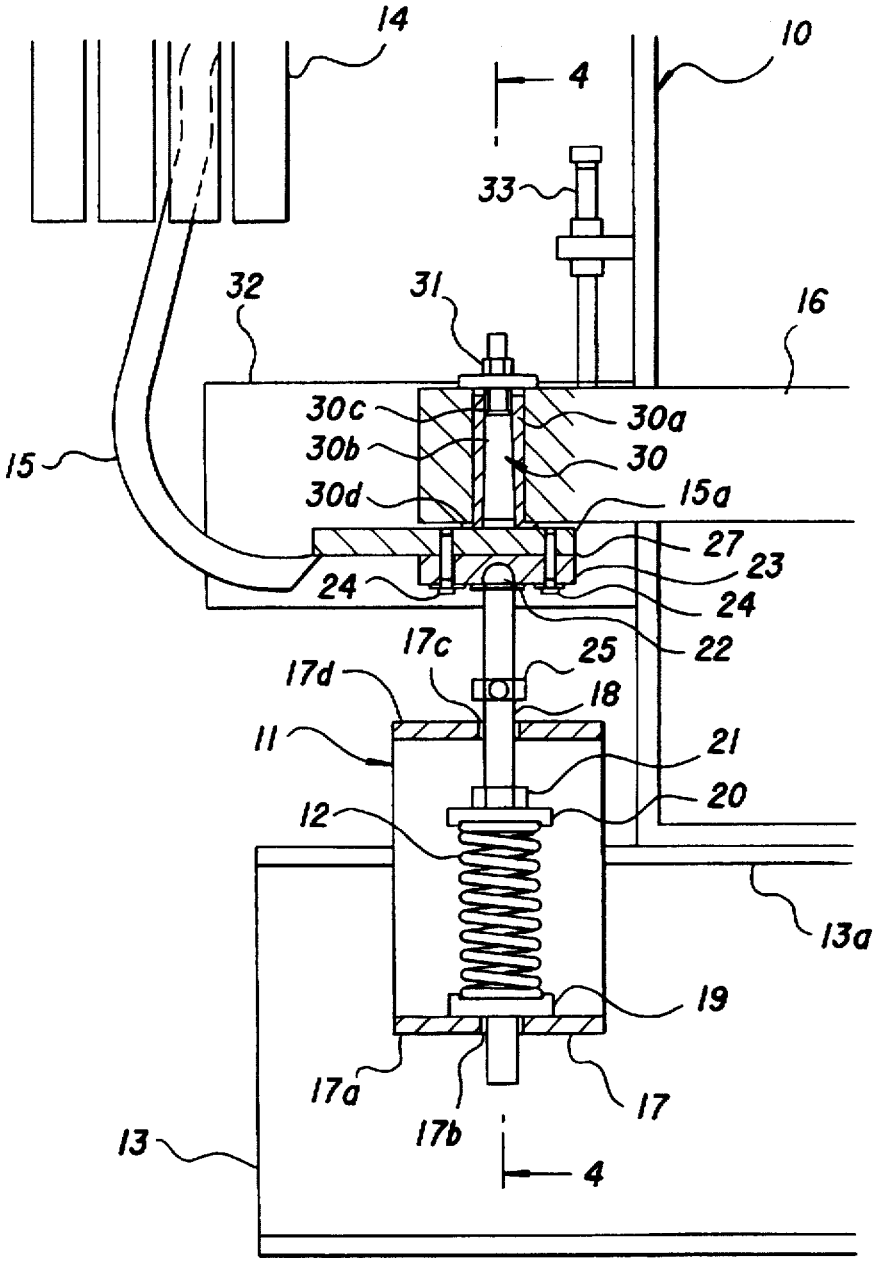
FIG. 3 is an enlarged cross-sectional view of the connection of FIGS. 1 and 2.
Figure 4:
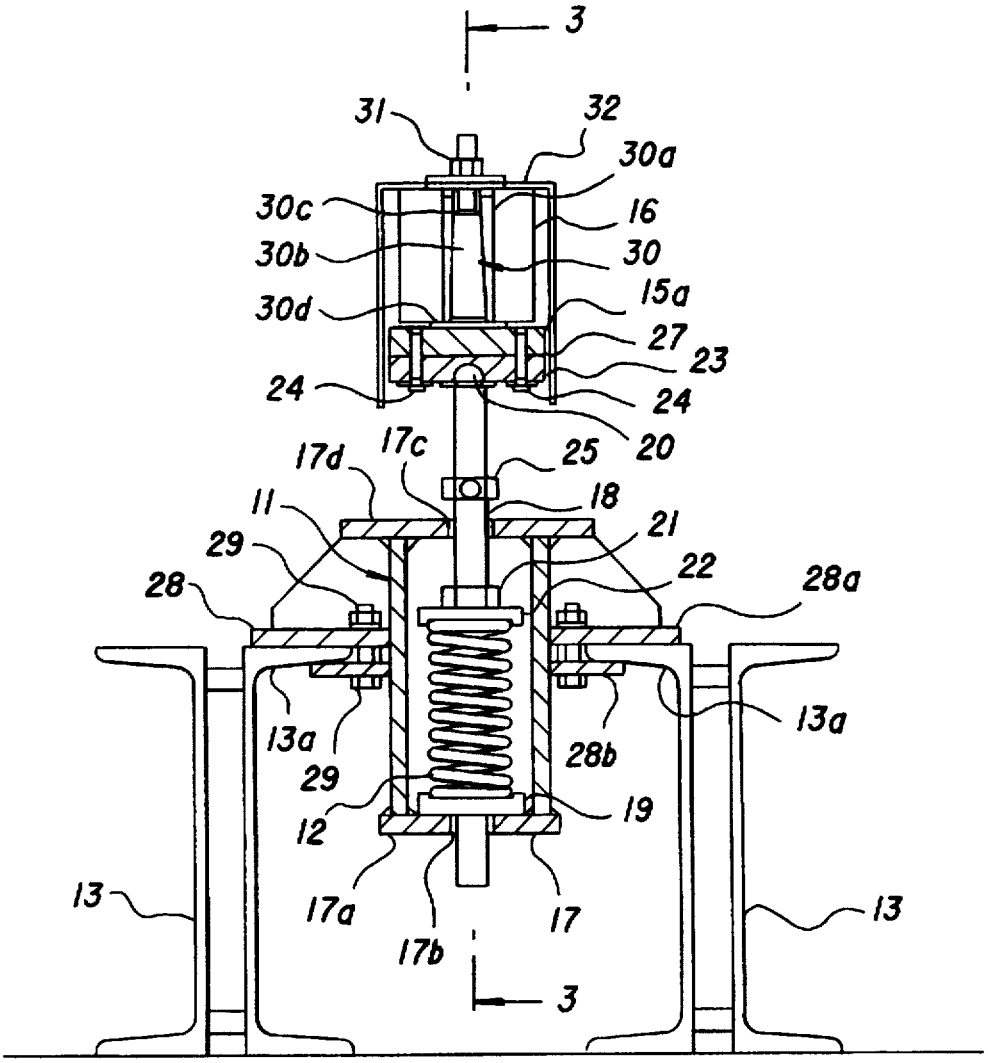
FIG. 4 is a cross-sectional view taken along line 4—4 of FIG. 3.

Referring to FIGS. 1 to 4 of the drawings, an empty pot 10 typically weighs some 80 tonnes including the insulation 9 but without the anode assembly 11 or base material (200 tonne with anode assembly).

In the first preferred embodiment of the invention, to achieve contact pressures of approximately 2 tonne per bar/strap connection with a vertical bias or greater with an angular bias, the pot 10 is lowered onto forty sprung contact assemblies 11 including compression coil springs 12 and mounted on support means 13 and connected to a ring bus 14. The contact assemblies 11 are located such that each of the contacts of the straps 15 are made with their respective collector bars 16. The strap and bar contacts are insulated from the rest of the contact assembly and the support means. Each of the contact assemblies 11 comprises a spring housing 17, a push rod 18 surrounded by the compression spring 12 which in turn is captured between locating plates 19 and 20. The lower locating plate 19 bears against a lower wall 17*a* of the housing 17 having an aperture 17*b* therethrough and through which the push rod extends. The upper locating plate 20 is in turn attached to the push rod and within the housing by an attachment nut 21, whilst the upper end portion of the push rod extends through an aperture 17*c* through an upper wall 17*d* of the housing to a ball joint connection 22 at the upper end of the push rod. The ball joint engages within a pressure plate 23 bearing against the underside of a copper tab 15*a* attached to the aluminium strap 15 extending from the ring bus 14, with the pressure plate 23 being located relative to the copper tab by locating bolts 24 and with insulating material 27 being sandwiched therebetween. There is an insulating sleeve around each bolt 24 and an insulating washer between the bolt 24 and the pressure plate. The push rod 18 carries an adjustable nut 25 above the upper wall 17*d* of the housing 17 which is used with an optional lever assembly (not shown) to lower the push rod and break the individual contact if required, whilst the attachment nut 21 on the upper locating plate 20 limits upper axial movement of the push rod by engagement with the underside of the upper wall 17*d*. The housing 17 is attached to the upper horizontal webs 13*a* of the support beams 13 by means of a clamping arrangement 28 including a first clamping plate 28*a* welded around the housing 17 and a second clamping plate 28*b* surrounding, but actually slidable along, the housing with clamping bolts and nuts 29 being provided between the clamping plates 28*a* and 28*b* which when tightened will firmly engage the clamping plates with the webs 13*a* of the support beams 13.

In order to achieve electrical contact between the collector bar 16 and the copper tab 15*a* of the strap 15 a tapered insert assembly 30 is provided, which consists of a sleeve 30*a* with an integral lower contact plate 30*d*, having an upwardly tapering axial passage 30*c* therethrough, and received within a hole 16*a* through the collector bar 16. A corresponding upwardly tapering member 30*b* is received within the passage 30*c*. The lower contact plate 30*d* which is integral with the sleeve 30*a* bears against the copper tab 15*a* to form an electrical connection between the tab 15*a* and the collector bar 16 via the tapered insert assembly 30. The member 30*b* is drawn into tight engagement with the sleeve 30*a* by means of a tightening nut 31 engaging a threaded extension of member 30*b*, whilst the tab 15*a* is held tightly against, and in electrical contact with, the contact plate 30*d* by the combined forces of the weight of the pot 10 and the upwardly directed force imposed on the push rod 18 by the compression spring 12. The connection is completed by a shroud 32 surrounding the position of the connection between the collector bar 16 and the tab 15*a*.

In order to enhance the quality of the electrical contact between the tab 15*a* and the collector bar 16, via the tapered insert assembly, the sleeve 30*a* with its integral lower contact plate 30*d* and the tab are formed from, or coated with, silver or a silver alloy. A silver or silver alloy to a silver or silver alloy contact is far superior to a steel (connector bar) to copper (copper tab) contact.

The angle of contact biasing may be vertical or rotated off vertical to increase contact pressure.

To allow for mechanical variations during the initial installation of the collector bars, an adjusting mechanism such as an adjustment screw 33 is provided above the collector bars to ensure no stress is placed on or transferred to the cathode assembly as a result of the making of the contacts.

Figure 5:
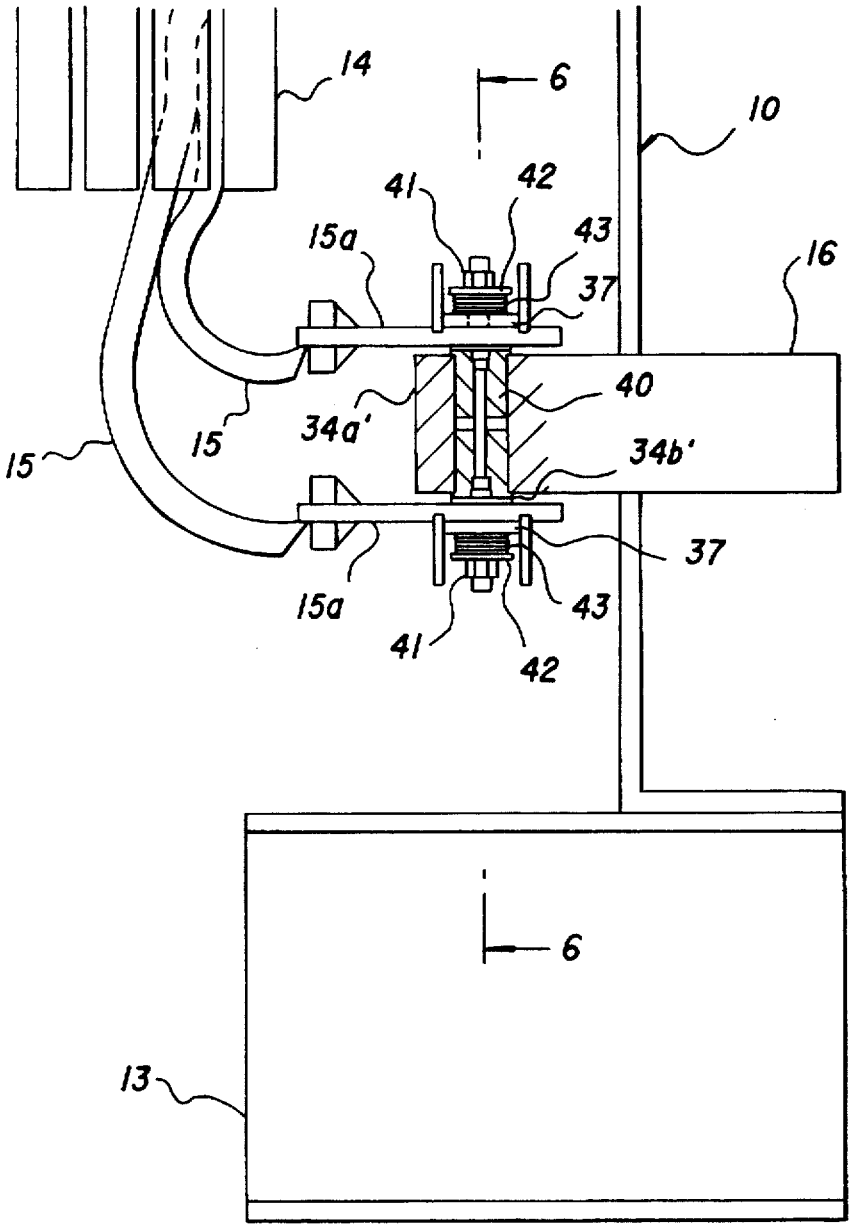
FIG. 5 is a cross-sectional view of a second preferred embodiment of the connection of the invention which allows for retrofit of the connection to existing smelters.

In the second embodiment of the invention, and with reference to FIGS. 5 and 6 of the drawings, like numerals have been used for the pot 10, support beans 13, ring bus 14, straps 15, tabs 15*a* and collector bar 16, as were used for the first embodiment of FIGS. 1 to 4 of the invention. This second embodiment is particularly adapted to allow retrofit connections for existing smelter pots and utilises a pair of straps 15 from the ring bus at each bar connection to provide a double electrical contact.

The connections of this second embodiment of the invention, although still utilising biasing means to achieve the primary electrical contact, rather than conventional bolted connections, still requires some access by workmen to the potroom floor or basement. Because of the relatively simple method used to make the connections utilising biasing in combination with a tapered sleeve assembly requiring lower contact pressures, access time is kept to a minimum and there is less personal risk to the workers.

In this second embodiment of the invention, a pair of opposed tapered insert assemblies 34 comprising opposed upper and lower inwardly tapering sleeves 34*a* and 34*b* are provided within corresponding inwardly tapering hole portions 35 through the collector bar 16 and a central socket head bolt 44 and nut 45 is provided through the sleeves. Each of sleeves 34*a* and 34*b* once again have contact plates 34*a*' and 34*b*'. As an alternative to silver or silver alloy plating each of the tabs 15*a*, each of the tabs are also fitted with opposed tapered insert assemblies 46 consisting of a sleeve 46*a* with an integral contact plate 46*d* having an inwardly tapering passage 46*c* therethrough, and received within a hole through each tab. A correspondingly upwardly tapering member 46*b* is received within the passage 46*c*. The lower contact plate 46*d* which is integral with the sleeve 46*a* bears against the contact plate 34*a*' to form the electrical connection. The arrangement for the lower tap is a mirror image. The clamping plates are interconnected by tie bolts 40 with nuts 41 at either end bearing against washers 42 between which washers and the adjacent respective clamping plate 37 are sandwiched stacks 43 of belleville washers which serve to bias the clamping plates 37 towards each other and as a result force the respective contact plates 34*a*' and 34*b*' into tight engagement with the corresponding contact plates 46*d* of the tapered insert assemblies fitted to the tabs 15*a*. Once again the tapered insert assemblies, including the contact plates 34*a*' and 34*b*', and the tabs 15*a* are all formed from, or are plated with, silver or a silver alloy to enhance electrical conductivity between the copper tabs 15*a* and the steel connector bar 16.

Figure 7:
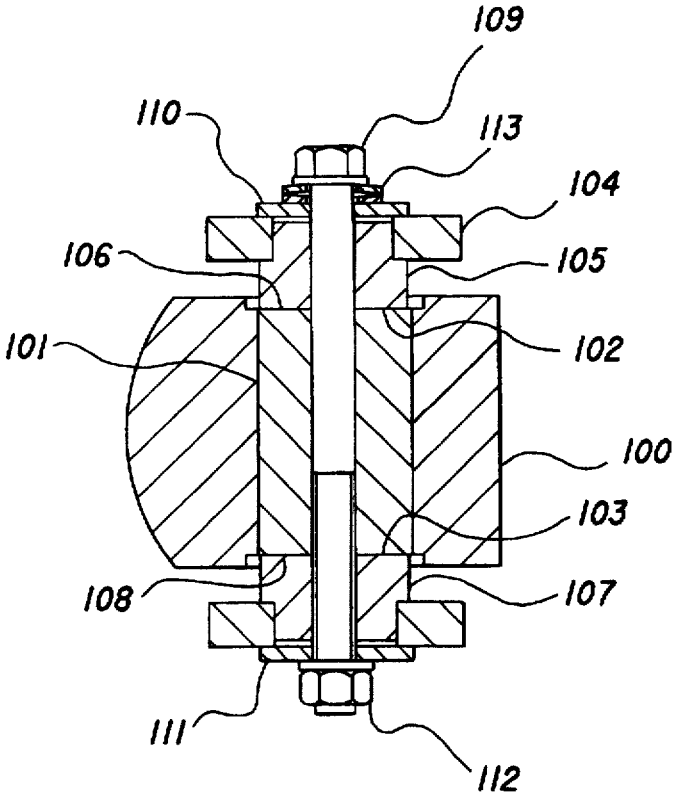
FIG. 7 is an end view cross-section of a bolted connection utilising the insert of the present invention.

FIG. 7 shows another embodiment of the invention which does not utilise the biased connection means as described with regard to FIGS. 1 to 6. Rather, the embodiment of FIG. 7 uses a collector bar insert and a bolted connection to obtain a good quality connection.

In the embodiment shown in FIG. 7, collector bar 100 has an insert 101 fitted into a hole formed in the collector bar. Insert 101 has contact surfaces 102,103 formed at either end thereof. Insert 101 has been shrink fitted into the hole in the collector bar and good electrical contact between the collector bar and the insert has been obtained. Respective contact surfaces 102,103 of insert 101 provide part of the interfaces for the bar/strap connections.

The connection also includes a top strap that is in contact with surface 102 of insert 101. Top strap has a copper tab 104 having a silver coated copper insert 105 mounted in a hole in tab 104. Insert 105 is shrink fitted into the hole in tab 104 to ensure good electrical contact between the tab and the insert. Insert 105 includes a contact surface 106 that, in use, comes into contact with contact surface 102 of insert 101 to ensure a high quality electrical connection between the collector bar and the top strap. A similar arrangement is provided with the bottom strap. The bottom strap is fitted with a silver coated copper insert 107 having a contact surface 108 that forms an electrical connection when placed in contact with contact surface 103 of insert 101.

In order to retain the bar/strap connections in place, a bolt 109 is inserted through axial passages formed in each of inserts 101, 105 and 107. Washers 110, 111, sized to ensure that the surface of the washers bear on the copper tabs and not the strap inserts, are positioned as shown. Nut 112 is placed on the thread formed on the lower end of bolt 109. Additionally, disc springs 113 are placed under the head of bolt 109. Tightening nut 112 brings surfaces 105,102 and 108,103 into contact, which establishes the electrical connection.

The connection illustrated in FIG. 7 is simple to assemble and uses joining techniques familiar to smelter operators. The spring discs 113 assist in maintaining the required pressure on the joint. If tension on the bolt is released, for example due to high temperature creep, the discs springs 113 expand to maintain the desired pressure.

With the arrangement shown in FIG. 7, a much lower contact pressure is required to obtain a desirable contact resistance than with conventional bolted joints. In conventional bolted joints, the bolts must be tightened to very high pressures. During operation of the cell, the bolt expands and lengthens due to thermal expansion and creep (it being appreciated that the connection operates at elevated temperatures) and these tend to reduce the contact pressure which, in turn, increases the contact resistance. To account for this, very high tightening pressures are applied to the bolts during initial connection. In contrast, the arrangement of FIG. 7 produces acceptable contact resistances at much lower contact pressures and the spring discs can adequately compensate for any loss in bolt pressure due to thermal expansion and/or creep.

FIG. 7 shows the use of a single collector bar insert. The invention would also work if two separate collector bar inserts were used in place of single insert 101. Further, FIG. 7 utilises strap inserts. The use of strap inserts may not be necessary and a good quality connection may be achieved by placing the copper tabs of the straps in contact with the collector bar insert. FIG. 7 also shows the collector bar insert as having end surfaces 102, 103 recessed below the surfaces of the collector bar. The collector bar insert may equally have its end surfaces extending above the surface of the collector bar.

The connection shown in FIG. 7 has the collector bar insert positioned in a hole that is located a short distance from the end of the collector bar. Connecting straps to both ends of the collector bar insert results in symmetrical current dispersion from the collector bar. The collector bar insert may also be positioned in a hole located in the end of the collector bar and extending along the axial direction of the bar into the bar. This arrangement also allows for desirable current dispersion characteristics.

Those skilled in the art will appreciate that the invention described herein is susceptible to variations and modifications other than those specifically disclosed. It is to be understood that the invention is considered to encompass all such variations and modifications that are all within its spirit and scope.

We claim:

1. A connection for connecting an electrical supply to the cathode of an aluminum smelter pot, including a collector bar embedded in the cathode, the bar having a body with a hole in the body extending to a surface of the bar, a flexible strap in electrical connection with the electrical supply and having a conductive tab, and an insert tightly fitted within the hole in the body of the bar for electrical contact with the collector bar of the cathode, the insert having a contact surface extending external to the collector bar forming an interface for electrical contact between the insert and the conductive tab of the strap.

2. A connection as claimed in claim 1 wherein the insert is made of a material having a higher conductivity than the collector bar.

3. A connection as claimed in claim 2 wherein the insert is made from a copper-based material or a copper alloy.

4. A connection as claimed in claim 1 wherein the insert is coated with a contact metal.

5. A connection as claimed in claim 4 wherein the contact metal is silver or a silver alloy strap.

6. A connection as claimed in claim 1 wherein the insert includes two contact surfaces which, in use, provide interfaces between the insert and the strap in the connection.

7. A connection as claimed in claim 1 claims wherein the bar/strap connection is a bolted connection, a clamped connection, or includes biasing means to apply pressure to the bar/strap connection.

8. A collector bar for an aluminum smelter pot, including a bar body, and an insert mounted within, mounted on, or mounted to the bar body, the insert having at least one contact surface external to the bar body for providing an interface for a bar/strap connection.

9. A collector bar as claimed in claim 8 wherein the insert has a higher electrical conductivity than the collector bar.

10. A collector bar as claimed in claim 9 wherein the insert is of a copper-based material or a copper alloy.

11. A collector bar as claimed in claim 9 wherein the insert is coated with at least one contact metal.

12. A collector bar as claimed in claim 11 wherein the contact metal is silver or a silver alloy.

13. A collector bar as claimed in claim 8 wherein the insert is a tapered insert.

14. A collector bar as claimed in claim 8 wherein the insert is a hollow insert and includes an axial passage having an internal taper.

15. An insert for forming a connection between a collector bar and a bus-bar strap, the insert comprising a body of material receivable within a hole in the collector bar for electrical contact between the insert and the collector bar, the insert having a contact surface at one end thereof, the contact surface forming an interface for electrical connection between the insert and the bus-bar strap.

16. An insert as claimed in claim 15 wherein the insert includes another contact surface at the other end thereof to provide another interface for forming a connection between the collector bar and the strap.

17. A method for forming an electrical connection between a collector bar of an aluminium smelter pot and a bus-bar strap comprising placing an insert into a hole in the collector bar such that the insert is in electrical contact with the collector bar, said insert having higher electrical conductivity than the collector bar, bringing the strap into contact with a surface of the insert and applying pressure to the strap such that the strap is forced into contact with the surface of the insert to bring the strap into electrical contact with the insert.

18. A method as claimed in claim 17 wherein the insert is cooled before being placed in the hole in the collector bar and as the insert warms, thermal expansion of the insert causes the insert to fit tightly in the hole to bring the insert into electrical contact with the collector bar.

19. A method as claimed in claim 17 wherein the step of placing the insert into the hole of the collector bar such that the insert is in electrical contact with the collector bar comprises providing a tapered insert, placing the tapered insert into the hole, and applying a force to the tapered insert in a downward direction of the taper to thereby force the insert into close contact with the collector bar.

20. A method as claimed in claim 19 wherein the insert has an internally tapered axial passage.

21. A method as claimed in claim 19 wherein the step of applying force to the axial passage comprises inserting a tapered plug into the axial passage and forcing the tapered plug further into the passage to thereby expand the insert.

22. A method as claimed in claim 11 wherein the step of placing the insert in the hole of the collector bar such that the insert is in electrical contact with the collector bar comprises providing a hollow insert having an axial passage, placing the insert in the hole and applying force to the axial passage to thereby expand the insert and cause the insert to thereby come into close contact with the collector bar.

23. A method as claimed in claim 17 wherein a bolt is used to apply pressure to the strap to bring the strap into electrical contact with the insert.

24. A method as claimed in claim 17 wherein electrical contact between the strap and the insert is caused by clamping means clamping the strap to the insert.

25. A method as claimed in claim 17 wherein biasing means is used to bring the strap and insert into electrical contact.

* * * * *